US005419554A

United States Patent [19]

Krone et al.

[11] Patent Number: 5,419,554

[45] Date of Patent: May 30, 1995

[54] SPORTS RACKET FRAME

[75] Inventors: James Krone, Portsmouth; Leslie E. Smith, Middletown, both of R.I.

[73] Assignee: Quadrax Corporation, Portsmouth, R.I.

[21] Appl. No.: 113,300

[22] Filed: Aug. 30, 1993

[51] Int. Cl.[6] ..... A63B 49/10

[52] U.S. Cl. ..... 273/73 F; 273/73 R

[58] Field of Search ..... 273/73 R, 73 C, 73 F

[56] References Cited

U.S. PATENT DOCUMENTS 3,915,783 10/1975 Goppel et al. .
4,023,799 5/1977 Van Auken .
4,028,477 6/1977 Goppel et al. .
4,070,019 1/1978 Segal et al. .
4,070,020 1/1978 Dano .
4,114,880 9/1978 Cecka .
4,124,670 11/1978 Cecka et al. .
4,128,963 12/1978 Dano .
4,129,634 12/1978 Cecka et al. .
4,194,738 3/1980 Inoue et al. .
4,212,461 7/1980 Cecka et al. .
4,294,787 10/1981 Lo .
4,390,182 6/1983 You ..... 273/73 F X
4,770,915 9/1988 Nakagawa et al. .
4,770,929 9/1988 Nobumasa et al. .
4,871,491 10/1989 McMahon et al. .
4,874,563 10/1989 McMahon et al. .
4,957,883 9/1990 Kobayashi et al. .
5,013,507 5/1991 Julien et al. .
5,076,872 12/1991 Nakagawa et al. .
5,176,868 1/1993 Davis .
5,198,058 3/1993 You .
5,273,279 12/1993 You ..... 273/73 F

*Primary Examiner*—Raleigh W. Chiu
*Attorney, Agent, or Firm*—Jacobson, Price, Holman & Stern

[57] ABSTRACT

A sports racket frame including a head portion and a handle portion formed from unidirectional high strength fibers impregnated with thermoplastic resin in the form of a sheet containing a plurality of adjacent strips in which the unidirection of the fibers in the strips are at different angles. The strips are made from unidirectional composite thermoplastic tape, and the sheet is rolled into an elongated hollow tube. Yoke components are also constructed from the composite material and the rolled hollow tube and yoke components are formed in the shape of a racket frame.

15 Claims, 10 Drawing Sheets

SPORTS RACKET FRAME

BACKGROUND OF THE INVENTION

1. Field of the Invention

This invention relates to a sports racket frame construction, especially a tennis racket frame constructed from a composite structure. The sports racket frame has a head portion and a handle portion constructed from a rolled up hollow tube which is constructed from a plurality of strips of unidirectional high strength composite material comprising unidirectional high strength fibers impregnated with thermoplastic resin, such as in unidirectional composite thermoplastic tape. The unidirection of the fibers in at least two strips are at different angles. The hollow tube is formed into the shape of the racket, placed in a mold together with yoke components constructed of the same composite material for consolidation of the hollow tube to form the frame.

2. Description of the Prior Art

Sports rackets such as especially tennis rackets, as well as squash rackets, racquetball rackets, badminton rackets, etc., have been constructed of numerous materials by using various techniques in an effort to obtain superior strength-to-weight and playability characteristics. Originally, tennis rackets, for example, utilized a frame of solid wood with various species of wood being used depending upon the characteristics of the selected wood as determined by the manufacturer and user. Subsequently, laminated wood tennis racket frames were manufactured of various wood materials and these structures sometimes included reinforcements. Laminated wood construction provided improvements over solid wood tennis racket frames but also included undesirable characteristics such as lack of uniformity, low tensile and compressive strength characteristics and relatively short life due to the tendency of the laminations to separate and for other reasons. When the laminated wood structure deteriorates due to warpage, scuffing and the like, the stiffness and strength properties of the frame are reduced as well as the color and appearance characteristics. In addition, it is difficult to manufacture a laminated wood tennis racket frame having uniform weight characteristics, balance characteristics and performance characteristics.

As a result of seeking sports rackets, especially tennis and racquetball rackets, having beneficial characteristics, metal tennis racket frames have been manufactured which usually include a tubular frame or a frame of some other cross section such as cylindrical, channel shaped, I-beam shape and the like usually constructed from extrusions of aluminum, magnesium, steel alloys or similar metallic materials which solve some of the problems of wooden rackets, but introduced their own problems of weight limitations which were encountered when endeavoring to achieve desired performance characteristics. Additionally, metal racket frames transmit vibration and shock forces to the player which contribute to player fatigue and tennis elbow injury. Also, tennis rackets with metal frames produce sounds that are sometimes found objectionable to players and spectators. Further, performance is adversely affected by a trampoline effect produced by metal tennis racket frames.

More recent efforts in the development of sports rackets have involved the use of resin materials reinforced with high strength fibers, particularly carbon fibers which are used to make the so-called graphite frame. The standard method of producing composite material racket frames is by using thermoset prepregs. These come in the form of unidirectional sheets, woven fabrics, or braided tubes.

In a conventional method, fiber-impregnated resin tennis racket frames are made starting with sheets of a prepreg material composed of aligned carbon fibers impregnated with uncured thermosetting resin, e.g., a B-stage epoxy resin. An uncured thermosetting resin is neither liquid nor solid, and creates a prepreg which is very drapable, soft and formable. It is also very tacky so that plies stick to each other and can be rolled up and packed in a forming mold for curing and forming.

According to this method, the sheets are cut at specific angles and rolled into the shape of an elongated tube. Successive layers are oriented at alternating angles, in order to impart directional rigidity and strength to the finished frame. Usually, the tube is formed on a cylindrical mandrel over an inflatable bladder or hand rolled. The mandrel is then withdrawn and the tube, still containing the bladder, is packed into a mold in the shape of the frame. In the mold, the bladder is inflated forcing the prepreg tube to conform to the shape of the mold, and the prepreg is the heat cured and hardened.

The foregoing method has the advantage of being able to produce high quality racket frames, but has numerous disadvantages. Since thermosetting resins are very tacky at room temperature, a significant amount of labor is required in forming the rolled tube and in packing it in the mold. Also, when using this method the prepreg tubes need to be stored in a cool environment. Further, the cured frame ofttimes has imperfections when then require significant work in hand finishing after removal from the mold. Furthermore, the use of thermosetting resins has come under recent criticism since such resins cannot be recycled and the discarded product made of such resins has become a serious disposal problem.

Thus, there has recently been intense interest in developing a reinforced thermoplastic resin racket which does not suffer the manufacturing difficulties of a thermosetting resin since thermoplastic resins can be reheated and recycled. Further, thermoplastic resins offer the possibility for even better strength-to-weight and playability characteristics. However, prior to the present invention, it has been generally recognized that the above-described process cannot, as a practical matter, be used with thermoplastics. In contrast to uncured epoxy prepregs, which at room temperature are drapable, a thermoplastic prepreg would be very hard, stiff and "boardy". In order to use the above process it would thus be necessary to heat the resin to a very high temperature first to form the tube, and again in order to pack the tube in the mold, making it difficult for workers to handle in racket forming operations. Also, a thermoplastic prepreg would possess no tack, making it difficult to form a tubular layup using multiple layers. Additionally, thermoplastic materials have a relatively small window near the melting point before they start to flow. Even assuming that the prepreg could be heated to the softening point without melting the resin, it would be difficult to maintain constant temperature during processing. As a result, attempts to manufacture a high strength sports racket utilizing a thermoplastic resin have been very limited.

There have been several proposals made, and several tennis rackets introduced to the market, which are made of injection molded, fiber-reinforced thermoplastics. However, these do not employ the same process used to make thermoset rackets, and do not have the same fiber structure. Instead, injection molded thermoplastic rackets are formed using a mixture of resin and short length fibers, which is injected into a racket mold. The fibers are disbursed through the resin in a random orientation to produce a material with isotropic properties. This has the advantage of simplifying the racket-forming process, in that the number of manual steps is reduced. However, injection molding processes posses the major limitation that, because the fibers pass through an injection nozzle, they cannot exceed about one-half inch. Inherently then, the reinforcing fibers are much shorter than in prepreg thermoset resin processes, and do not produce the same strength and overall racket stiffness as in the case of the longer fibers present in a thermoset racket. Moreover, known thermoplastic processes have the disadvantage that the fiber orientation cannot be controlled.

U.S. Pat. No. 5,176,868, assigned to Prince Manufacturing, Inc., which is directed to the Prince "VORTEX" tennis racket, utilizes the combination of a plurality of reinforcing fibers with a thermoplastic resin and is composed of commingled thermoplastic filaments and reinforcing fibers which are braided to form a flexible sleeve with the flexible sleeve being placed in a mold having a cavity in the shape of a tennis racket frame with a bladder being disposed within the sleeve. The mold is closed and heated until the thermoplastic melts and the bladder is pressurized so that the sleeve conforms with the mold and, after cooling is removed from the mold as a tennis racket frame.

This process of the Prince U.S. Pat. No. 5,176,868, however, has several drawbacks. Initially, there is the necessity for a separate braiding operation. Next, the bias of the fiber orientation is limited by the braiding to about $-15°$ to $+15°$, thus limiting the reinforcing capabilities of the fibers. Further, the injection of the dry thermoplastic resin into the braided fibers inherently results in nonuniformity of the resin impregnation. Also, the bulkiness of the impregnated braid makes it difficult to place in the forming mold because individual fibers tend to stick out from the tows. In addition, the nature of the braiding system prevents selective variations in the cross-sectional thickness at desired locations in the racket frame, as well as variations in the specific strength characteristics which can be designed into a rolled prepreg for selected locations in the racket frame.

U.S. Pat. No. 4,070,020, issued in 1978, discloses the formation of a tennis racket utilizing a rolled tube of graphite fiber and thermosetting resin. The rolled tube is made using a veiling strip, cellulose sleeve and a core of an expandable material with the plies of resin impregnated unidirection graphite fiber sheets, veiling strip, cellulose sleeve and core being placed in a mold and heated to curing temperature. When so heated, the core is caused to expand thus producing an internal pressure within the tube in the mold cavity so that the mold forms the tube into the shape of a racket frame, at the same time that the thermosetting resin is cured. While the patent discloses that the resin material could be a thermoplastic, there is no disclosure as to how the thermoplastic sheets could be rolled into the form disclosed or how the aforesaid recognized problems associated with making a racket using thermoplastic resins are solved.

The following additional U.S. patents are relevant to this invention.

| | | |
|---|---|---|
| 3,915,783 | 4,128,963 | 4,874,563 |
| 4,023,799 | 4,194,738 | 4,957,883 |
| 4,028,477 | 4,212,461 | 4,983,242 |
| 4,070,019 | 4,294,787 | 5,013,507 |
| 4,114,880 | 4,770,915 | 5,076,872 |
| 4,124,670 | 4,770,929 | 5,198,058 |
| 4,129,634 | 4,871,491 | |

None of the prior patents, however, disclose a sports racket frame constructed from a rolled up elongated hollow tube made from unidirectional thermoplastic composite tape in which a plurality of strips of unidirectional high strength fibers impregnated with thermoplastic resin are rolled into the hollow tube.

SUMMARY OF THE INVENTION

By the present invention, the elongated hollow tube constructed from unidirectional high strength fibers impregnated with a thermoplastic resin can produce a racket frame which has numerous advantages over presently known racket frames constructed of thermosetting resins as well as tennis rackets constructed of thermoplastic resins in which the high strength fibers are braided. The frame of this invention produces an enhanced playability or performance characteristics of the finished racket by enhancing the strength to weight characteristics and at the same time providing very favorable vibration dampening properties, thus lessening the possibility of tennis elbow. A sports racket made in accordance with the present invention maintains a dynamic stiffness, provides very favorable velocity ratios between an approaching or incoming tennis ball and an outgoing tennis ball, and maintains longer contact between the ball and racket strings. These features provide favorable control characteristics.

The elongated hollow composite material tube permits the elimination of any expandable core material and veiling strip used with the rolled tube of the prior art. Also, the present invention eliminates the necessity of a braiding operation and the spreading apart of the braided high strength fibers when injected with the dry thermoplastic resin, as well as the problems of nonuniformity and various strength and thickness limitations encountered with the known prior art rackets which utilizes braided reinforcing fibers.

It is the principal object of the present invention to construct a sports racket frame from unidirectional composite thermoplastic material of unidirectional high strength fibers impregnated with thermoplastic resin to form a rolled up hollow tube, with the tube constructed from a plurality of strips of composite material with the unidirection of the fibers in at least two adjacent strips being at different angles.

It is a further object of the invention to form the hollow tube into various high strength products, such as sports racket frames, especially tennis rackets, by forming the tube into the desired final shape.

Another object of this invention is to provide a hollow rolled prepreg made from unidirectional thermoplastic composite tape, especially suited for sports rackets, in which the unidirection of the high strength fibers can be preselected for $-90°$ orientation to $+90°$ orientation depending upon the strength characteristics to be incorporated into the finished product.

Still another object of the present invention is to provide a hollow rolled prepreg made from unidirectional composite tape in which the thermoplastic wall thickness can be preselected in accordance with a desired finished cross-section profile of the sports racket to be made from the rolled prepreg.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS OF PREFERRED EMBODIMENTS

DESCRIPTION OF THE PREFERRED EMBODIMENTS

Figure 1:
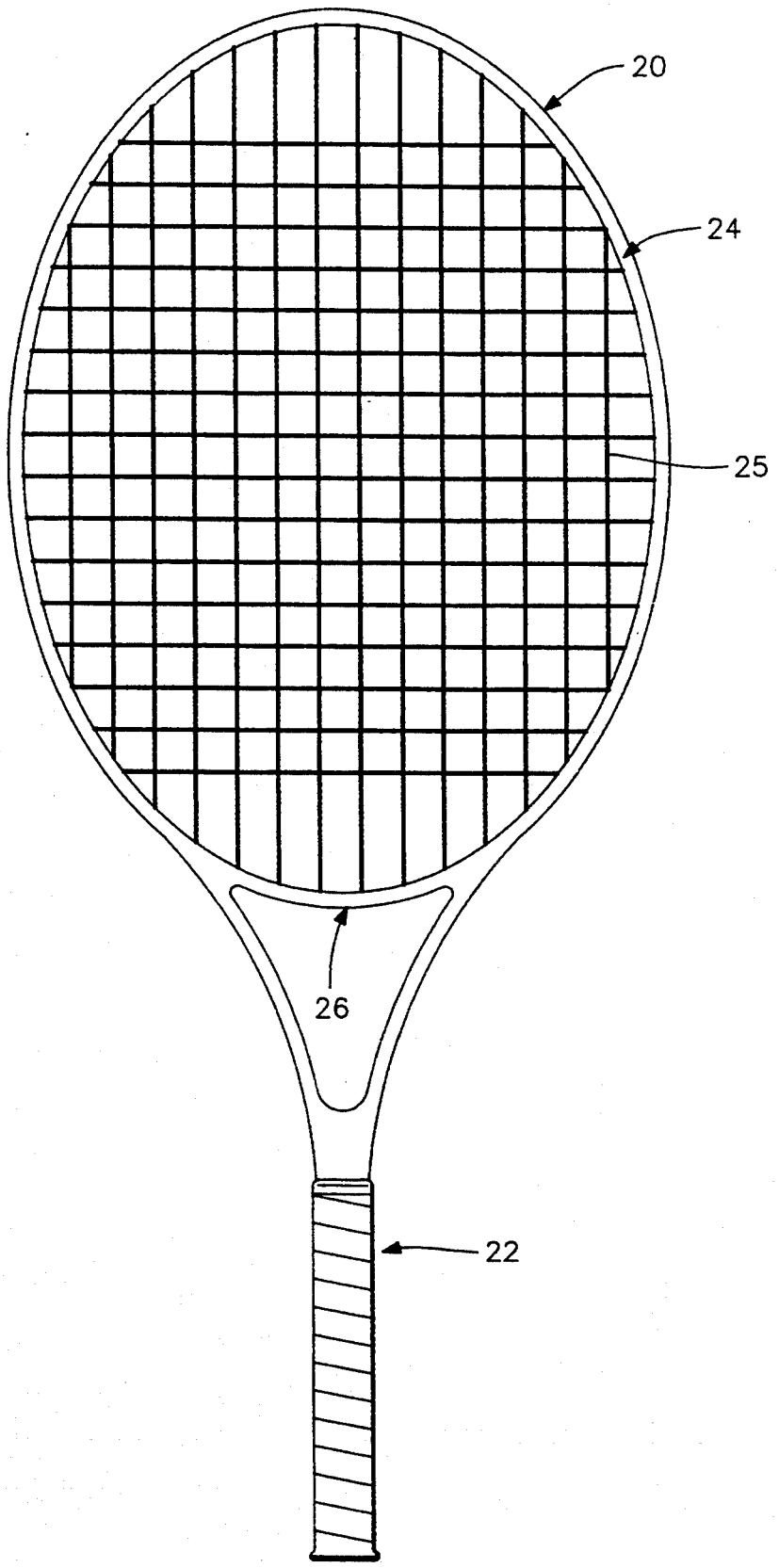
FIG. 1 is a perspective view of a tennis racket constructed in accordance with the present invention.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

A tennis racket constructed in accordance with the present invention is illustrated in FIG. 1 and designated at 20. The racket is of conventional shape and configuration and includes a handle portion 22, a head portion 24 with strings 25 and a throat or yoke 26 at the juncture between the handle portion 22 and head portion 24. The dimensional characteristics and the configuration of the head portion and other components of the racket may be varied in a manner conventional and well known in the art depending upon the performance requirements to be satisfied. The present invention specifically relates to the structure of the racket frame from composite material. All sports racket frames are contemplated by the present invention, although tennis rackets are especially suited. Other sports rackets include squash, racquetball, badminton, paddle ball as well as others.

Figure 7A:
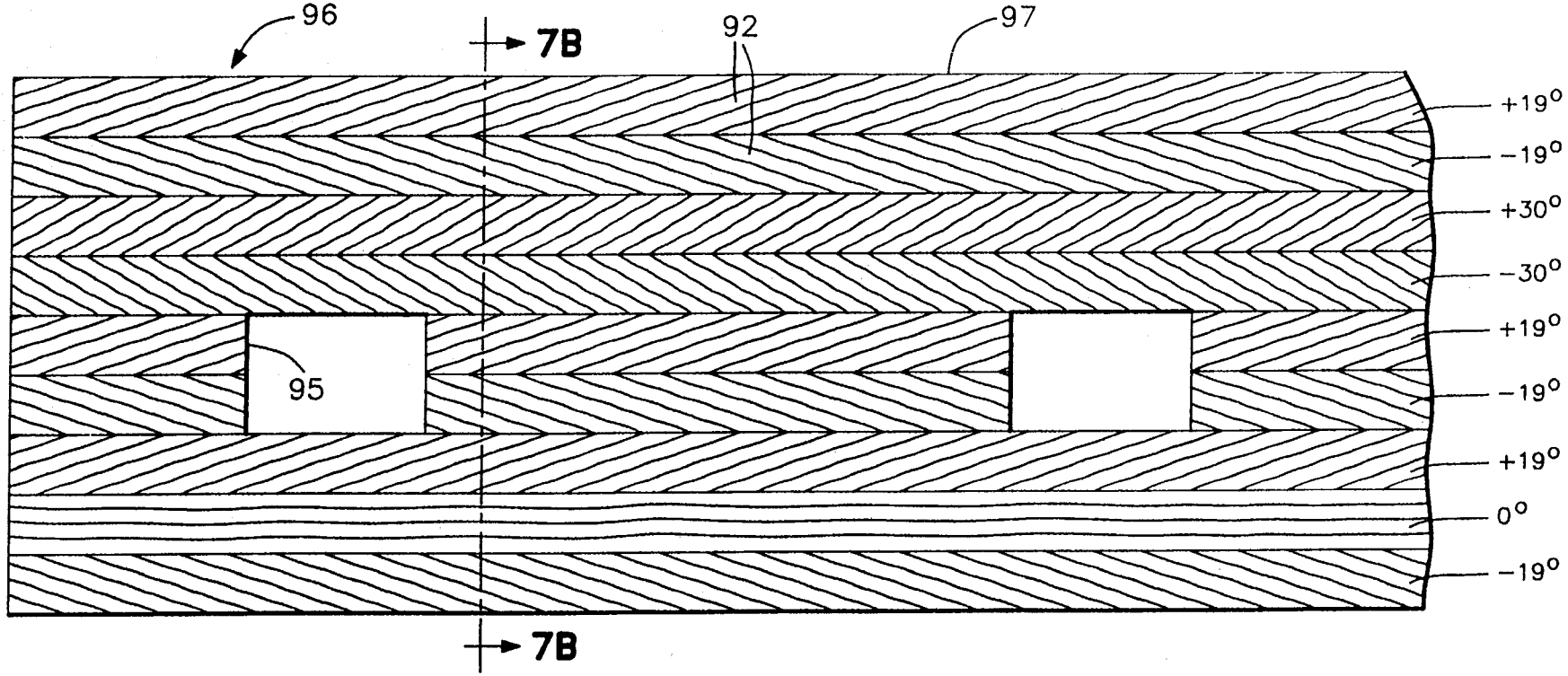
FIGS. 7A is a top plan view and 7B is a sectional view taken along section line 7B, respectively, illustrating an example of the structure of the composite material used in forming the rolled up tubes and yoke components.
Figure 7B:
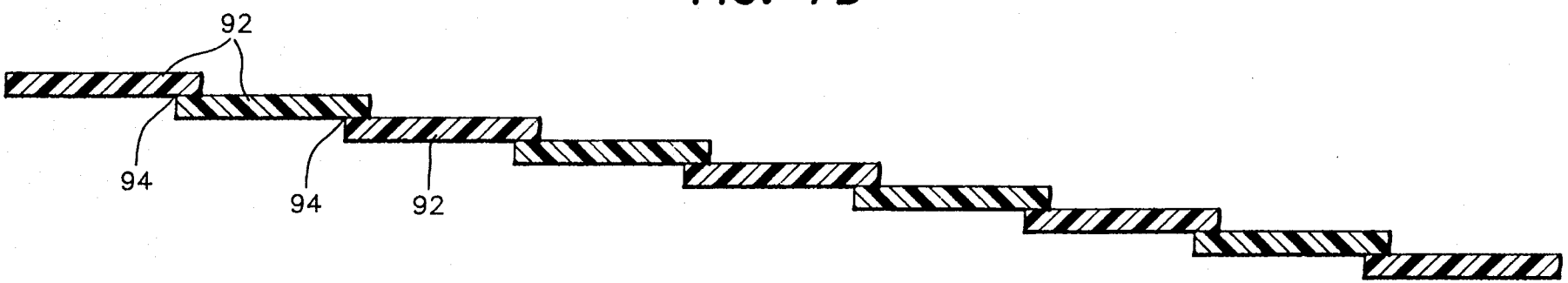

The composite material used in constructing the racket frame of this invention is illustrated in FIGS. 7A and 7B and includes a plurality of strips of unidirectional high strength fibers impregnated with thermoplastic resin in which the unidirection of the high strength fibers in adjacent strips are at different angles.

It is possible to use any of the reinforcement fibers currently used in thermoset rackets, as well as any other suitable reinforcing high strength fibers. This would include fiberglass, Kevlar, Boron, and ceramic. However, carbon fiber is preferred. Numerous thermoplastic materials are also suitable for use with the present invention. Nylon 6 is preferred because of its low melting point, good flowability, and good toughness. It is also available in unidirectional composite tape containing carbon fibers suitable for the present invention. However, other thermoplastic materials, such as Nylon 6/6, Nylon 11, Nylon 12, Nylon 6/12, polyester, polycarbonate, polypropylene, ABS, polyethylene, polyphemylene sulfide (PPS), or polyetheretherketone (PEEK) may also be used.

In forming the structure illustrated in FIGS. 7A and 7B, unidirectional composite tape which is constructed of unidirectional high strength fibers impregnated with a thermoplastic resin is used, such as 12 inches wide for example. Any convenient width can be used. A plurality of lengths of the unidirectional tape is cut from the roll and edge seamed together. While dimensions may vary depending upon the end use of the composite material, the edge seaming of four 48 inch lengths of the 12 inch wide unidirection tape has been satisfactorily used to form a generally 48 inch square sheet of composite material.

This sheet is then cut into a plurality of strips by the use of a conventional shearing machine with the plurality of strips having the unidirectional of the fibers at different angles that results from angling the guide bar of the shearing machine to different angles in relation to the unidirection of the fibers in the 48 inch square sheet. The strips that are shear cut from the sheet of unidirection fibers may have different angular relations with the present invention preferably providing strips for a tennis racket frame in which the angles of the unidirection high strength fibers are 19°, 30°, 45°, 0° and 90° in relation to the original unidirection of the fibers in the square sheet. The strips are cut preferably in about 62 inch lengths for a tennis racket frame.

FIGS. 7A and 7B disclose the structure of the composite material in the form of sheet 96 utilized in forming the tennis racket with the assembly illustrated in FIG. 7A including a plurality of strips 92 which are preferably edge seamed together at 94, as shown in FIG. 7B, to facilitate handling and roll up into the elongated hollow composite structure. As indicated by the angles of the unidirection of the high strength fibers in FIG. 7A, adjacent strips have the unidirection of the fibers at different angles. It is preferably that the bias angle of the unidirection of the fibers in any strip is counter-balanced by an equal bias angle in another strip in an opposite direction.

It is pointed out that the number of strips, their width and length and association of different angles of the unidirectional fibers may be varied depending upon the end use of the sheet of composite material 96. As illustrated, void areas 95 may be provided in certain strips to vary the thickness of the hollow tube depending upon variations in the desired thickness of the final product. In some instances, an entire strip may be omitted depending upon the strength and thickness buildup to be introduced. However, adjacent strips still have their unidirection of the high strength fibers at different angles. This sheet 96 of composite material whether it be a continuous sheet or an interrupted sheet is then used in forming the components of the tennis racket frame.

Figure 4A:
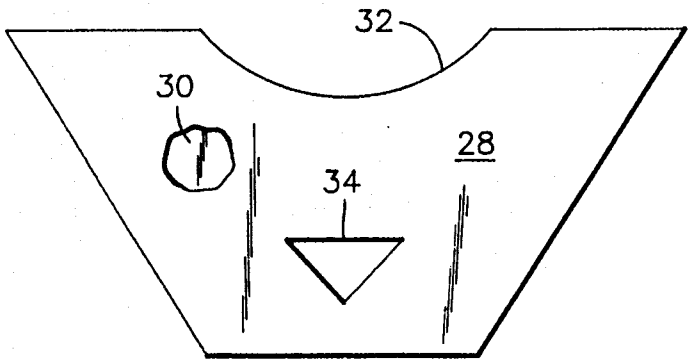
FIGS. 4A–4E illustrate the lay up procedure used in forming the yoke components.
Figure 4B:
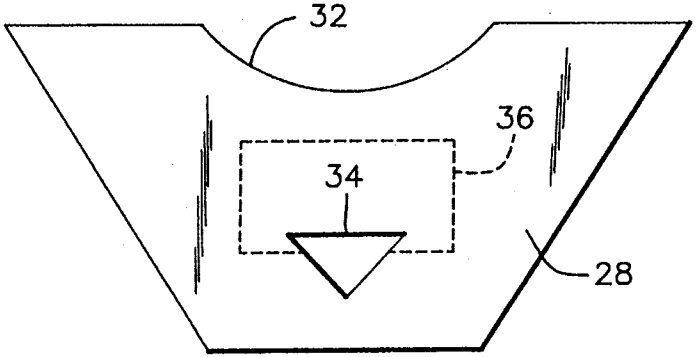
Figure 4C:
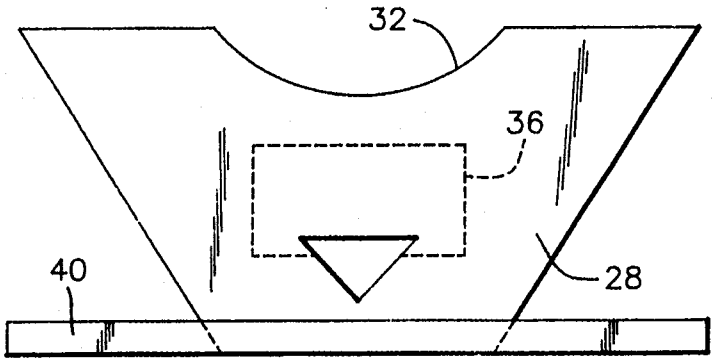
Figure 4D:
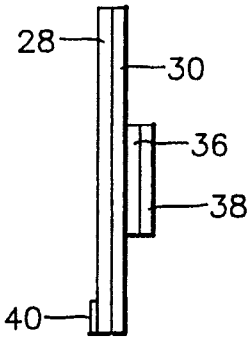

FIGS. 4A–4E and FIGS. 5A, 5B and 6 illustrate the structure and method of making the yoke components in a preferred form of the present invention. In FIG. 4A, two prepreg unidirectional tape sheets 28 and 30 in which the unidirection of the high strength fibers are at +30° and −30° respectively are positioned in overlying relation and melted at a temperature of approximately 480° F. to consolidate the two sheets 28 and 30 with the temperature being maintained for approximately ten minutes and sufficient pressure (50–200 psi) being applied to bond the sheets together. A top radius 32 is formed in the sheets 28 and 30 along with a small triangle 34. Then, two additional sheets 36 and 38 of smaller external circumference in which the unidirection of the fibers is +30° and −30° respectively are melted to sheet 30 as illustrated in FIGS. 4B and 4D. Also, a narrow strip 40 of composite material having a length of about 14 inches is tack welded to the base of the sheets opposite to the top radius 32 with the purpose of this tape being to secure the laminated sheets in a mold to form the yoke components illustrated in FIG. 6 by using the mold or form illustrated in FIG. 5.

Figure 2:
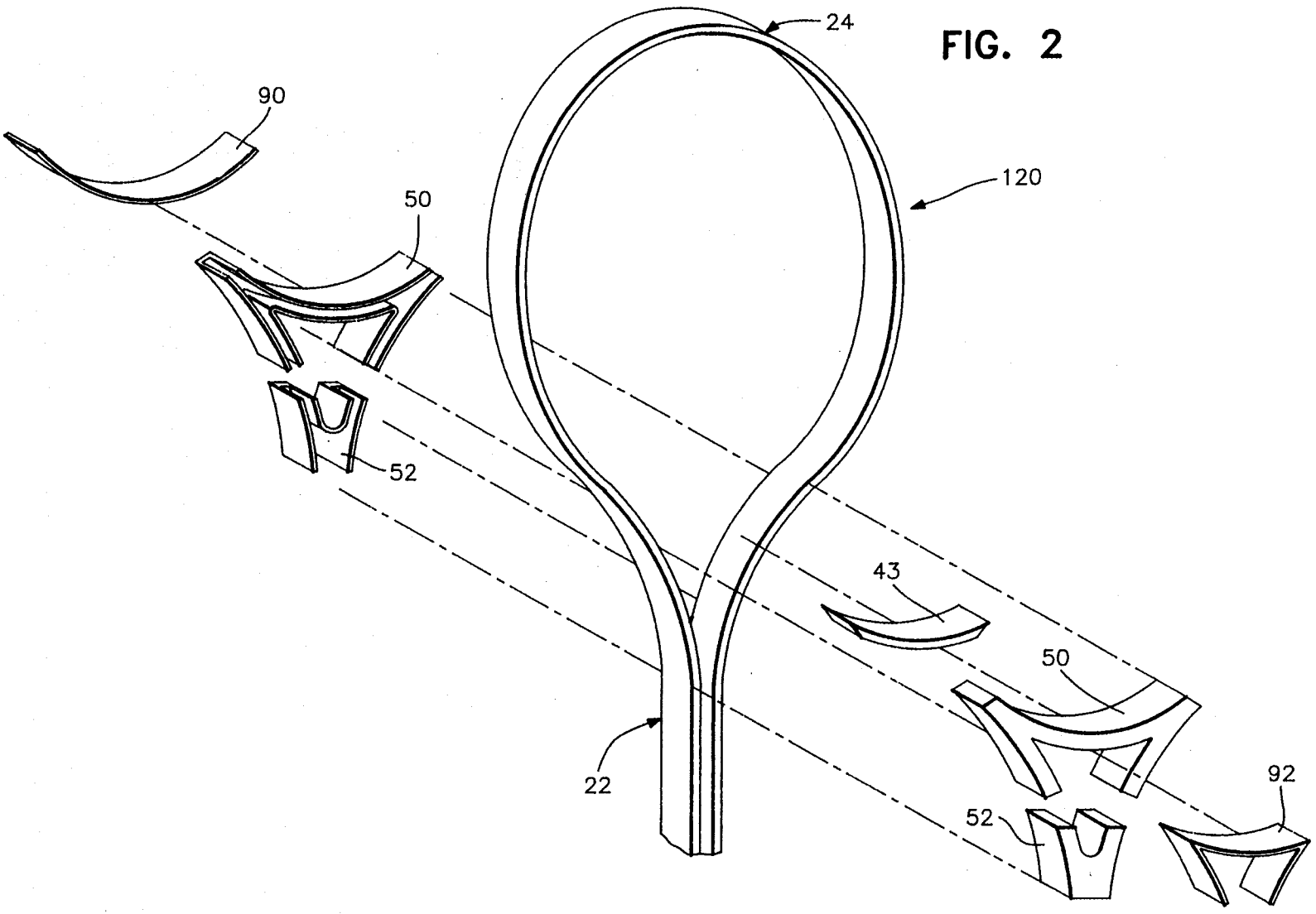
FIG. 2 is a group perspective view of the components of the tennis racket frame illustrating the orientation of the components.
Figure 4E:
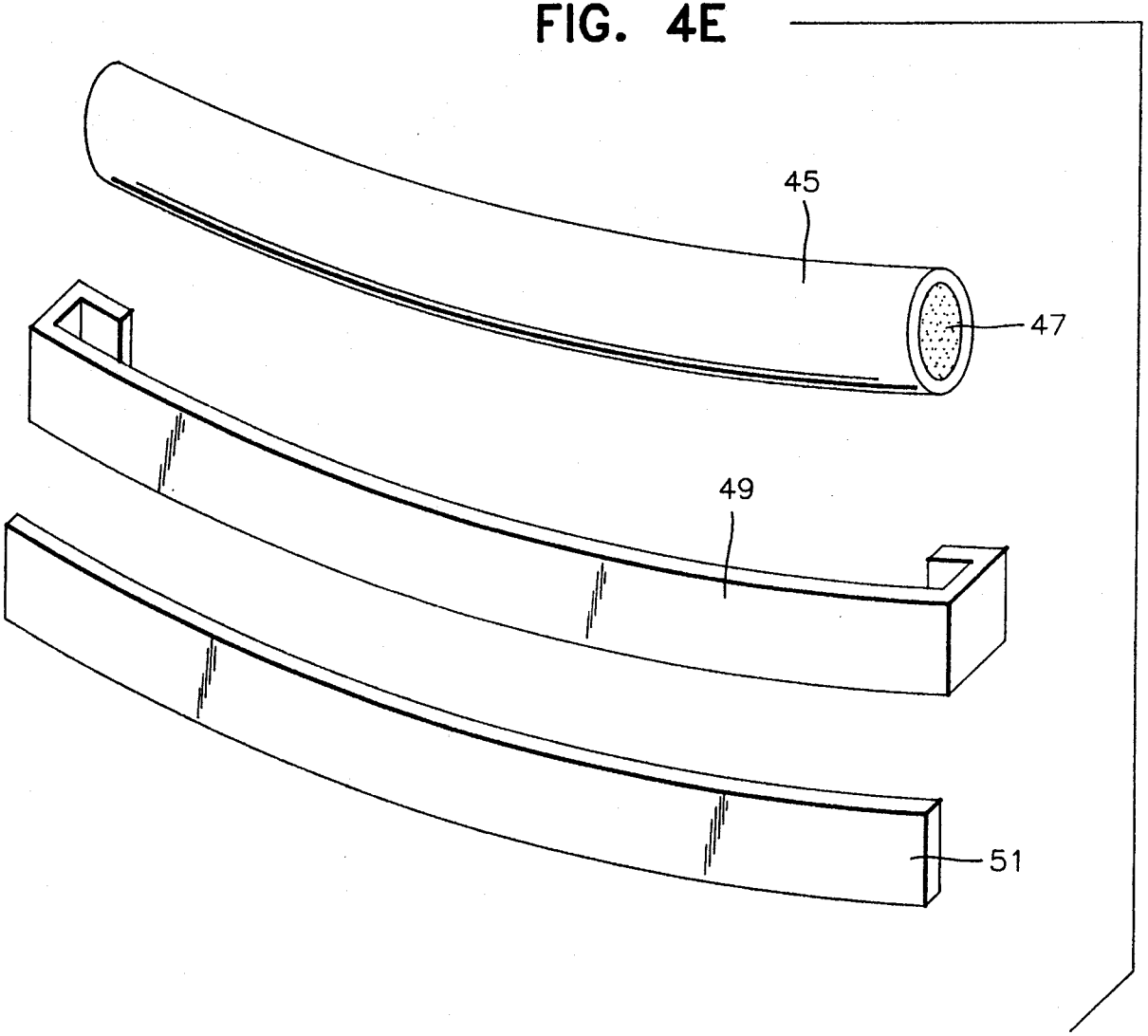
Figure 5A:
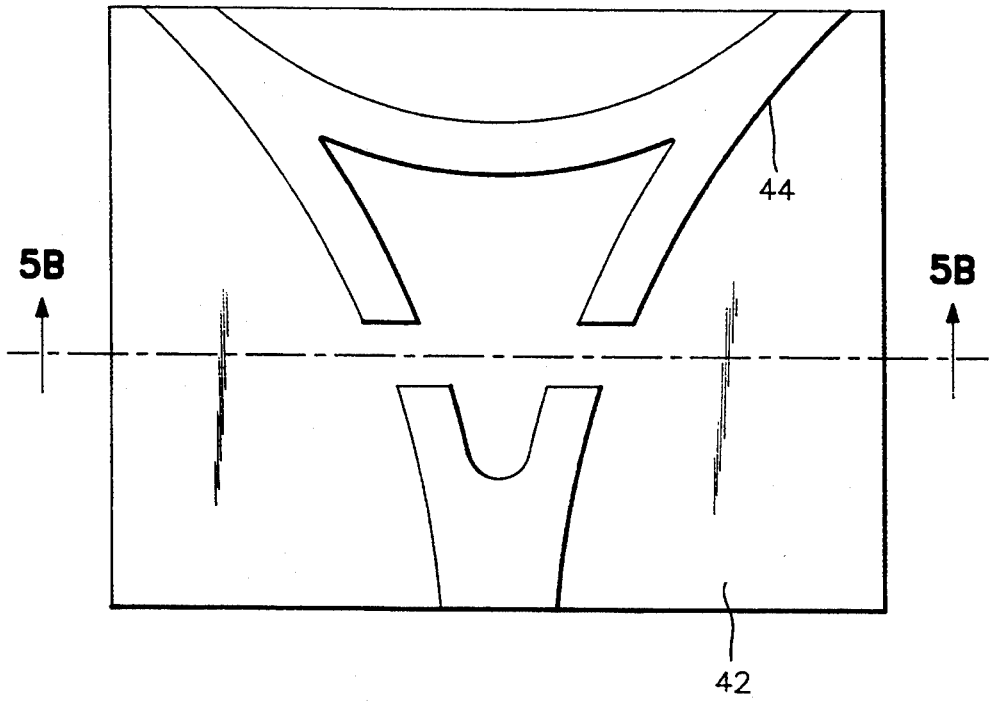
FIGS. 5A and 5B illustrate the construction of the yoke forming tool.
Figure 5B:
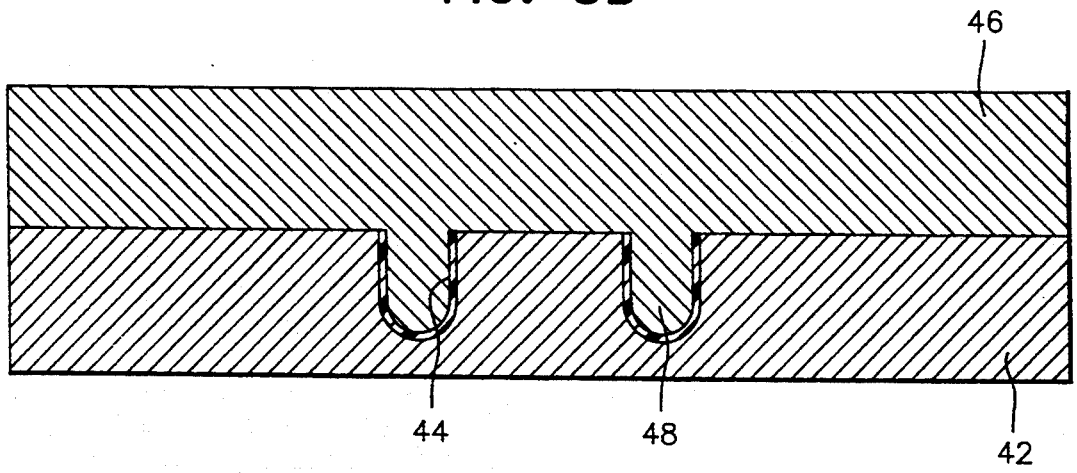

FIG. 4E illustrates the formation of a preferred yoke component 43 illustrated in FIG. 2 which includes a hand rolled up tube 45 from the same composite material as sheet 96. The tube 45 is formed into an arcuate configuration and includes a bladder 47 containing polyethylene and a blowing agent. A backing strip 49 and backing strip 51 both of the same composite tape are tack welded to the tube 45 with the unidirection of the fibers in the strip 49 being 0° and the unidirection of the fibers in the strip 51 being 90°.

Figure 6:
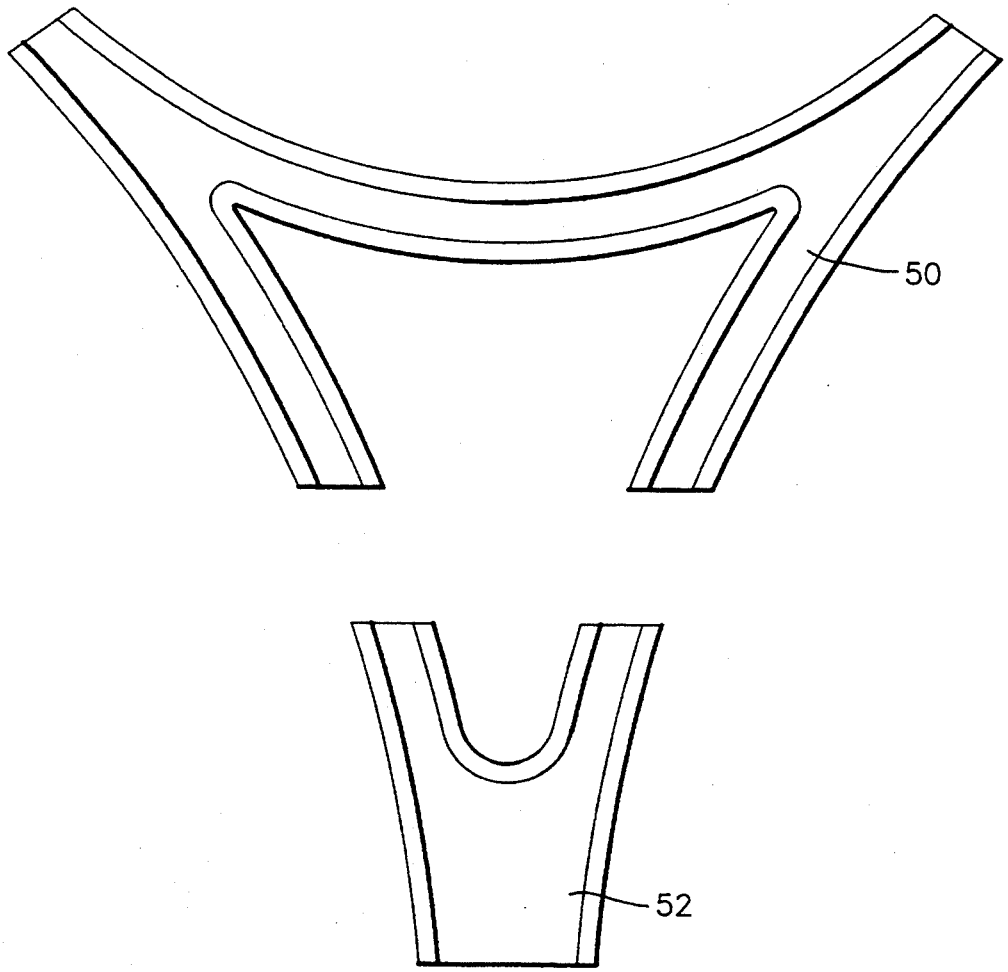
FIG. 6 illustrates the final construction of two of the yoke components.

The layup illustrated in FIG. 4D is placed in a mold or thermal former to slide under an infrared heater at 475° to 525° F. The female component of the thermal former is designated by reference numeral 42 in FIGS. 5A and 5B and is provided with recesses or groove 44 receiving the laminated sheets 28, 30, 36 and 38 with the tape 40 retaining this assembly in position. A male component 46 of the former provided with projections 48 received in the groove 44 is used to shape and form the yoke components 50 and 52, as shown in FIG. 6 and in FIG. 2 under 500–3000 psi. The yoke components 50 and 52 and the yoke component 43 as well as the yoke components 90 and 92 are all assembled in relation to the racket frame preform in the mold as illustrated in FIG. 2.

Figure 8:
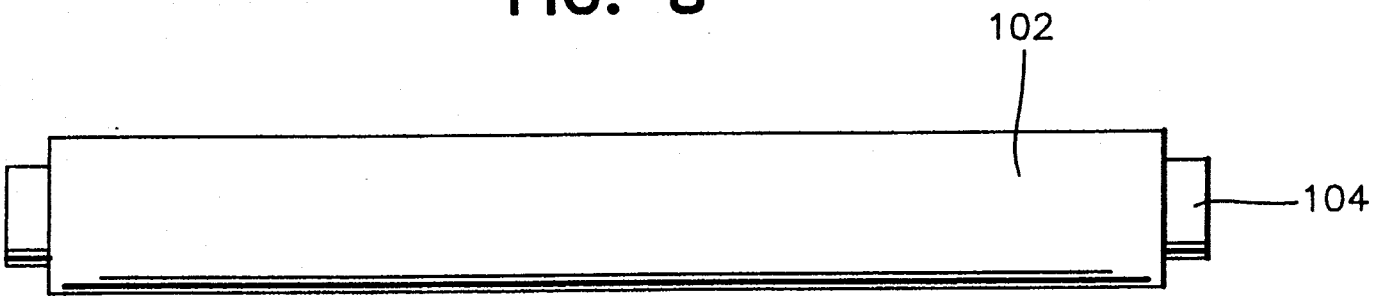
FIG. 8 is an elevational view of the rolled up tube of composite material on the tubular bladder.

FIG. 8 illustrates the rolled up tube 102 resulting from the composite material 96 being rolled up with an internal silicone bladder 104. The bladder 104 has a length longer than the rolled up tube 102 in order to remove the bladder after formation of the rolled up tube 102 into a racket frame. A release cloth may be provided around the bladder at each end of the rolled up tube 102 to prevent the roll from pinching the bladder at each end during bending. In accordance with the present invention, the wall thickness of the rolled up tube 102 is preferably about 40–50 mils. However, the wall thickness may be as low as about 20 mils and as high as about 70–80 mils if lightweight materials are used.

At least one convolution of the composite material 96 forms the rolled up tube 102. However, many convolutions are preferred although the number of convolution or revolutions depend on the strength and weight requirements to be formed into the finished product, and generally involves anywhere from five to fifteen revolutions, or more. The widths of the strips forming the composite material 96 may also vary and the relationship of the strips will vary as the revolutions or convolutions of the roll up tube increase inasmuch as there is an increase in the circumference of the roll up tube as the numbers of convolutions increase. Thus, by selecting specific arrangements of strips and the unidirectional angles of the fibers, various structural arrangements may be incorporated into the rolled up tube 102 for various end uses. However, without being limiting, it is preferable to cut the strips 92 in widths which approximate one convolution so that in the final composite structure the unidirection of fibers in each convolution changes from one unidirection to the next. Thus, the width of the strips 92 increase progressively in small increments from the leading edge 97 since the circumference of the rolled up tube increases with each revolution during the roll up. As shown, the preferred sheet 96 has 9 strips 92 which will produce a hollow composite structure having 9 convolutions.

The specific thermoplastic resin involved and the thickness of the composite material can vary along with the ratio of fiber to resin in the composite material which also may vary. For example, the thickness of the composite material 96 may be from 3 to 10 mils, maybe even thicker, and the thickness may vary depending upon the unidirection of the high strength fibers. In the present preferred form for a tennis racket, the 0° angle unidirectional strip is preferably 6.4 mils in thickness and all other strips are preferably 5.3 mils in thickness, with the thicknesses varying plus or minus 0.4 mils. The fiber to resin ratio preferably is 62% carbon fiber and 38% nylon 6 resin by weight plus or minus 3% for making a tennis racket. However, depending upon the selected high strength fiber and particular thermoplastic resin, and the desired characteristics for the high strength end product, the fiber to resin ratio may range from as low as 45% fiber to a high of 70% fiber by weight.

Figure 3:
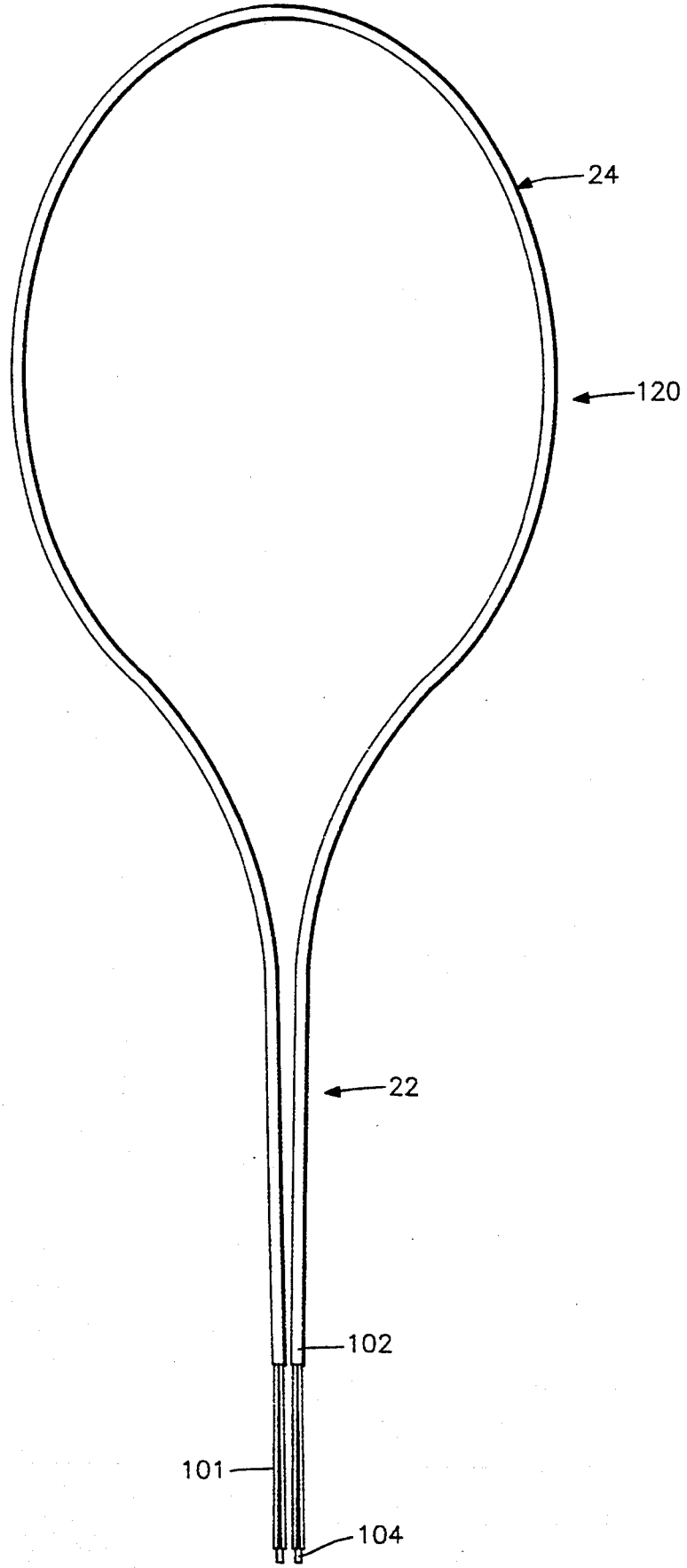
FIG. 3 is a perspective view of the preform resulting from bending and shaping the preheated rolled up tube.

The rolled up tube 102 with bladder 104 is formed into the preform 120 as illustrated in FIG. 3 and which has a shape of the tennis racket frame. The bladder 104 is then sealed and pressurized. The preform is then assembled with the yoke components in an appropriate tool or mold and then placed in a hot press. The thermoplastic resin is then heated to the desired temperature to provide a uniform consolidated structure and the racket tool or mold is removed from the hot press and cooled.

If the frame has any mold imperfections after formation, the thermoplastic material allows the frame to be remolded to rectify the imperfection. This is in contrast to a thermoset frame which cannot be remolded once the resin is cured. An imperfectly molded thermoset frame must be discarded.

The racket frame may then be surface finished by light sanding or cutting excess material by use of a knife or the like and the racket frame is then drilled by taping the inside of the racket frame head with fiber tape and drilling through the outer casing only with small holes. A two-step drill is then used to drill through the inner casing to the depth of the small diameter holes only and then large holes are drilled in the outer casing and using the two-step drill, the inner casing drilled to the depth of the small diameter holes and the racket frame is then removed from a drill jig used for drilling the holes. All of the inner holes are then drilled to the proper size by a drill press using the outer holes as a guide and the inner holes as drill spots. The tape is then removed and the frame can be finish sanded, deburred around the drill holes to enable stringing of the tennis racket in a conventional manner.

Further, the foregoing should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A high strength sports racket frame including a head portion and a handle portion, which comprises unidirectional high strength fibers uniformly impregnated with a thermoplastic resin, said head portion and handle portion formed from a series of adjacent strips each of said strips being made from unidirectional composite thermoplastic tape rolled into a hollow tube, the unidirection of the fibers in at least two of said strips being at different angles.

2. A sports racket frame in accordance with claim 1 wherein a bias angle of the unidirection of fibers in any strip is counterbalanced by an equal bias in another strip in an opposite direction.

3. A sports racket frame in accordance with claim 1 wherein said adjacent strips are arranged in a pattern selected in accordance with a desired finished cross-section profile of said frame formed thereby.

4. A sports racket frame in accordance with claim 1 wherein said high strength fibers are carbon filaments and said thermoplastic resin is nylon.

5. A sports racket frame in accordance with claim 1 wherein the unidirection of the fibers in said strips can be varied from −90° orientation to +90° orientation.

6. A sports racket frame in accordance with claim 1 wherein the unidirection of the fibers in said strips is selected in accordance with desired strength characteristics of the frame.

7. A sports racket frame in accordance with claim 1 wherein said hollow tube is combined with molded unidirectional thermoplastic composite material laminants to complete said frame.

8. A sports racket frame in accordance with claim 1 wherein said strips having the unidirection of the fibers at different angles being adjacent contiguous strips.

9. A sports racket frame in accordance with claim 1 wherein said frame includes a throat portion at the juncture between the head portion and handle portion, said throat portion including molded laminated members formed from unidirectional high strength fibers uniformly impregnated with thermoplastic resin with the angle of the unidirection fibers being different in the laminants.

10. A high strength sports racket frame including a head portion and a handle portion, which comprises unidirectional high strength fibers uniformly impregnated with a thermoplastic resin, said head portion and handle portion formed from a series of adjacent strips made from unidirectional composite thermoplastic tape rolled into a hollow tube, the unidirection of the fibers in at least two of said strips being at different angles, said strips being connected to each other along their adjacent lengthwise edges to form a sheet, said sheet being rolled into said hollow tube.

11. A sports racket frame in accordance with claim 10 wherein said connected strips are edge seamed with minimum overlap.

12. The sports racket frame in accordance with claim 10 wherein said sheet includes areas in which said strips are discontinuous to alter physical characteristics of certain portions of the frame.

13. A sports racket frame in accordance with claim 10 wherein said frame includes a throat portion at the juncture between the head portion and handle portion, said throat portion including molded laminated members formed from unidirectional high strength fibers uniformly impregnated with thermoplastic resin with the angle of the unidirection fibers being different in the laminants.

14. A sports racket in accordance with claim 10 wherein the unidirection of the fibers in said strips can be varied from −90° orientation to +90° orientation.

15. A sports racket in accordance with claim 10 wherein said strips having the unidirection of the fibers at different angles being adjacent contiguous strips.

* * * * *